United States Patent [19]

Dean et al.

[11] 4,060,429

[45] Nov. 29, 1977

[54] MANGANESE-NICKEL ALLOYS

[75] Inventors: Anthony Vincent Dean, Solihull; Philip James Ennis, Birmingham, both of England

[73] Assignee: The International Nickel Company, Inc., New York, N.Y.

[21] Appl. No.: 573,627

[22] Filed: May 1, 1975

Related U.S. Application Data

[63] Continuation-in-part of Ser. No. 431,676, Jan. 9, 1974, abandoned.

[30] Foreign Application Priority Data

May 13, 1974 United Kingdom ..... 2516874

[51] Int. Cl.[2] ..... C22C 22/00; C22C 30/00; C22C 38/58

[52] U.S. Cl. ..... 148/31; 75/122; 75/128 A; 75/128 P; 75/134 B; 75/134 C; 75/134 F; 75/134 M; 148/32; 148/38

[58] Field of Search ..... 75/122, 134 F, 134 M, 75/128 A, 134 B, 134 C, 128 P; 148/31, 32, 38

[56] References Cited

U.S. PATENT DOCUMENTS

| | | | |
|---|---|---|---|
| 1,803,467 | 5/1931 | Driver et al. | 75/128 A |
| 2,133,291 | 10/1938 | Gordon | 75/122 |
| 2,706,696 | 4/1955 | Payson | 75/128 A |
| 3,235,378 | 2/1966 | Jennings | 75/128 A |
| 3,266,876 | 8/1966 | DeLong et al. | 75/128 A |

*Primary Examiner*—R. Dean

*Attorney, Agent, or Firm*—Raymond J. Kenny; Ewan C. MacQueen

[57] ABSTRACT

The resistance to general corrosion and stress corrosion cracking of manganese-nickel alloys are improved through the incorporation of special amounts of chromium and iron.

8 Claims, No Drawings

MANGANESE-NICKEL ALLOYS

This application is a continuation-in-part of U.S. application Ser. No. 431,676, filed Jan. 9, 1974, abandoned.

The present invention is directed to manganese-nickel alloys, and particularly to overcoming, or at least significantly minimizing, the inherent drawbacks of such alloys in terms of various corrosion resistance characteristics.

As is generally recognized in the art, binary manganese-nickel alloys containing from about 15 to 40% nickel exhibit good workability, both hot and cold. However, this does not necessarily obtain, as we have found, when such alloys are relatively heavily alloyed with certain other constituents such as chromium and iron. For even a nickel level of 20% tends to detract from workability.

In any case, in terms of corrosion resistance, such binary alloys have been known to manifest a propensity to rather rapidly tarnish and to prematurely evidence general corrosion in the atmosphere and in aqueous environments such as domestic supply water and seawater. Moreover, in such aqueous environments these binary alloys are also highly susceptible to stress-corrosion cracking. Undoubtedly, the inability to better resist the ravages occasioned by certain corrosive media has somewhat limited the usefulness of these alloys in many industrial and commercial areas.

Therefore, the primary thrust of the invention was to improve the resistance of manganese-nickel type alloys to both general corrosion and stress-corrosion cracking, but without concomitantly deleteriously affecting workability characteristics. This desideratum has been achieved in accordance with the subject invention through incorporation of special and correlated amounts of chromium and iron together with controlling the percentages of manganese and nickel and other constituents present within certain ranges as hereinafter delineated.

Generally speaking, the most advantageous alloys contemplated herein contain (weight per cent), apart from impurities, about 8 or 10% to about 13 or 14% nickel, about 8 or 10 to about 12% chromium, about 35 or 40% to 50 or 55% iron, and from about 18 to 45% manganese.

Nickel must be present in the alloys for adequate stress-corrosion resistance and general corrosion resistance. For this purpose, at least 8 or 10% should be present although this may be extended down to 5%. While the nickel content can be as high as 17.5% this level should not be exceeded since much above this percentage the alloys increase in hardness and become more difficult to work. Generally, this constituent need not exceed 15% and, given costs, advantageously should not extend beyond about 13%, a range of 8 to 12% being quite satisfactory generally.

The presence of chromium is necessary to impart good resistance to atmospheric corrosion and to general corrosion, for example, in domestic supply water, seawater and a 3% aqueous solution of sodium chloride. And while the chromium content can be as low as 5% in some instances, it should not exceed 15% as amounts in excess of this figure detrimentally affect workability. Generally, the upper chromium level should not exceed 11 or 12%. However, it should be underscored that irrespective of the conferred attributes of chromium, in the absence of iron stress-corrosion resistance is still poor. There appears to be an interrelated effect resulting from the co-presence of chromium and iron, though the theoretical explanation which might explain the mechanism involved is not yet completely understood.

Iron has little or no effect on the general corrosion resistance of manganese-nickel alloys, though it somewhat improves stress-corrosion resistance. Surprisingly, however, in alloys containing chromium in the percentages set forth above and additionally containing iron as above indicated, both the general corrosion resistance and stress-corrosion resistance are remarkably good, general corrosion resistance being generally better than that of cupro-nickel aloys of high copper content or of nickel silvers, though not as good as that of stainless steels.

In striving for the optimum in terms of corrosion resistance, particularly stress-corrosion resistance in, for example, chloride containing media, the chromium content preferably exceeds 8% and the iron content preferably exceeds 35%, but preferably does not exceed 55%. The percentages of iron can be as low as 30% and as high as 60%, but one or more properties may not be as good as otherwise might be.

With regard to manganese, we have recently found that it can be as low as 18%, though it is to advantage that the manganese level not fall below 20%. Alloys containing 18%, e.g., 20%, to 25% manganese are deemed particularly useful in production of coins. For most general purposes a manganese range of from 20%, say 24%, to 40% is considered particularly satisfactory. In any case, it should never exceed 55% since higher percentages lend to poor workability.

Small amounts of copper up to 2.5%, but preferably no more than 1.5%, may be present in the alloys, although the presence of this element may cause some loss of workability. Additionally, lead in amounts up to 2% may be added if desired to improve machinability, though the addition of this constituent impairs hot workability to some extent.

Impurities that may be present include silicon in amounts up to 1% and carbon in amounts up to 1%. Greater amounts of either of these elements can detrimentally affect workability. Therefore, each of these constituents preferably should be held below 0.5% or even 0.25%. Phosphorus and nitrogen can also be tolerated, e.g., in amounts up to 0.5%, preferably no more than 0.1%, of each.

Preferred alloys of the invention contain from 8 to 12% nickel, from 8 to 12% chromium and from 40 to 50% iron, the balance, except for impurities, being manganese.

A particularly useful combination of low cost, both hot and cold workability as well as resistance to general corrosion and stress-corrosion cracking is exhibited by alloys containing from 10 to 12% nickel, from 10 to 12% chromium, nominally 50% iron and balance essentially manganese.

As above indicated, certain of the alloys of the invention are particularly useful for coinage. For this and other purposes where low enough hardness to take an impression from a coining die is required while slightly lower corrosion resistance can be tolerated, alloys containing, apart from impurities, about 10 to 15% nickel, about 8 to 12% chromium, 18 to 25% manganese and about 51 to 60% iron are particularly suitable. In such alloys the carbon and silicon contents should be as low as practicable and preferably neither exceeds 0.1%, and most advantageously do not exceed 0.03%. Preferred coinage alloys contain, apart from impurities, from 11 to 13% nickel, from 9 to 11% chromium, from 19 to 21% manganese, and from 55 to 60% iron.

An added benefit of the alloys of the invention is that, in general, they do not require annealing during cold working. However, prior to severe cold deformation such as in deep drawing or to obtain lowest hardness to prevent excessive die-wear during coinage production, an annealing treatment, for example, heating for one hour at 900° C., may be employed.

The following data is given as illustrative of the invention.

Alloys having the compositions set forth in Table I were air-melted in a high frequency furnace, cast as 125mm × 50mm ingots weighing about 3 kg in cast iron molds, forged at about 900° C. to 16mm plate and cold rolled to 0.037mm strip. The stress-corrosion resistance of each alloy was measured by means of Thompson's loop test (as described, for example, in D. H. Thompson: Materials Research & Standards, Feb. 1961, p. 108) using U-bend specimens taken from the strip prepared in the above manner.

In this test the U-bend specimen is "stressed" by forcing the ends of the specimen together and holding them in that position while the specimen is immersed in the corrosion medium. After releasing the ends, the stress-corrosion resistance is then measured by calculating the extent to which the corrosion has caused the specimen to depart from its original U-bend shape. This can conveniently be expressed as a percentage relaxation, and an arbitrary relaxation of 50% or more between the specimen ends is chosen to denote failure.

The stress-corrosion resistance of each alloy is shown in Table I by the number of hours to failure as denoted by 50% relaxation between the ends of the U-bend specimens immersed in the specified medium. In this test "> 3150", "> 1600", etc., signifies that no cracking had been observed during the test run, the tests being discontinued after the specified time. In a number of instances data pertaining to percentage relaxation after a test period of 1000 hours are given.

in that, in the annealed condition very little corrosion, if any, had occurred before the tests were discontinued after the given time periods.

On the other hand, of the Alloys A to H, all of which are outside the invention, Alloys E, F and G exhibited good general corrosion resistance but marked inferior stress-corrosion resistance as compared with the alloys of the invention, while Alloys A to D exhibited inferior resistance to both general corrosion resistance and stress-corrosion. Alloy H, containing only 3% nickel, possessed only fair general corrosion resistance and was charactermized by poor stress-corrosion resistance in comparison with Alloys 1–10.

With respect to workability, alloys in accordance herewith possess good hot and cold workability as evidenced from the method in which the U-bend specimens for the Thompson loop test were prepared. The detrimental effect on workability of an excessive amount of chromium is illustrated by the fact that it was not found to be possible to prepare good U-bend specimens for the Thompson loop test by the above method (which involves both hot and cold workability) from alloys containing more than about 15% chromium. This lack of workability is emphasized by tests on alloys having different chromium contents. These alloys, the compositions of which are shown in Table II, were air-melted and cast as 3 kg ingots for forging or hot-rolling or both, and thereafter cold-rolling. The results are reported in Table II in which "S" indicates successful working without cracking and "F" indicates that the test failed.

TABLE II

| Alloy No. | Composition (%) Ni | Fe | Cr | Mn | Hot-Rolling: Forging (900° C.) | Hot-Rolling: Hot Rolling (900° C.) | Cold-Rolling: Comments | Cold-Rolling: Reduction Achieved (%) |
|---|---|---|---|---|---|---|---|---|
| 11 | 7.1 | 49.4* | 10.4 | 33.1 | — | S | S | 95 |
| 12 | 9.9 | 47.3* | 10.6 | 32.2 | — | S | S | 95 |
| 13 | 12.0 | 54.0* | 10.0 | 24.0 | S | S | S | 95 |
| 14 | 10.0 | 48* | 12.0 | 30.0 | S | S | S | 95 |
| 15 | 13.0 | 48* | 14.0 | 25.0 | S | S | S | 95 |
| 10 | 12.2 | 45.5* | 15.0 | 27.3 | S | S | S | 95 |

TABLE I

| Alloy No. | Composition (%) Ni | Fe* | Cr | Mn | General Corrosion Resistance | Stress-Corrosion Resistance: Domestic Water, Strip Annealed at 800° C.: Time to Failure (hours) | % Relaxation after 1000 hours | 3% NaCl Solution, Strip Annealed at 800° C.: Time to Failure (hours) | % Relaxation after 1000 hours | 3% NaCl Solution, Cold-rolled strip: Time to Failure (hours) | % Relaxation after 1000 hours |
|---|---|---|---|---|---|---|---|---|---|---|---|
| 1 | 16.5 | 35 | 10 | 38.5 | good | >3150 | — | >4150 | — | >3150 | — |
| 2 | 15 | 40 | 10 | 35 | good | >3150 | — | >4150 | — | >3150 | — |
| 3 | 13.5 | 45 | 10 | 31.5 | good | >3150 | — | >4150 | — | >3150 | — |
| 4 | 12 | 45 | 15 | 28 | good | n.d. | — | n.d. | — | >1600 | 6 |
| 5 | 10.5 | 50 | 15 | 24.5 | good | >1650 | 3 | >1650 | 2 | >1600 | 7 |
| 6 | 10.5 | 55 | 10 | 24.5 | good | >1650 | 3 | >1650 | 2 | >1600 | 5 |
| 7 | 12 | 50 | 10.5 | 27.5 | good | n.d. | — | >1650 | 2 | n.d. | — |
| 8 | 14.5 | 41 | 10.5 | 31 | good | >3700 | 7 | n.d. | — | n.d. | 3 |
| 9 | 7 | 49.5 | 10.5 | 33 | good | >3700 | 4 | n.d. | — | 170 | — |
| 10 | 10 | 47.5 | 10.5 | 32 | good | >3700 | 4 | n.d. | — | 1500 | — |
| A | 30 | — | — | 70 | poor | <0.2 | — | <0.2 | — | 1.2 | — |
| B | 21 | 30 | — | 49 | poor | n.d. | — | 19 | — | n.d. | — |
| C | 18 | 40 | — | 42 | poor | n.d. | — | 26 | — | n.d. | — |
| D | 15 | 50 | — | 35 | poor | 1064 | 28 | 192 | — | n.d. | — |
| E | 27 | — | 10 | 63 | good | <0.4 | — | <0.1 | — | <0.2 | — |
| F | 21 | 20 | 10 | 49 | good | <0.1 | — | <0.1 | — | n.d. | — |
| G | — | 50 | 10 | 40 | good | n.d. | — | n.d. | — | 250 | — |
| H | 3 | 51 | 10 | 36 | fair | 650 | — | 72 | — | n.d. | — |

Note:
n.d. = not determined
*by difference

It can be seen from the results set forth in Table I that Alloys Nos. 1 to 10, all of which are in accordance with the invention, possessed good general corrosion resistance and exhibited excellent stress-corrosion resistance TABLE II-continued

| Alloy No. | Composition (%) Ni | Fe | Cr | Mn | Hot-Rolling Forging (900° C.) | Hot Rolling (900° C.) | Cold-Rolling Comments | Reduction Achieved (%) |
|---|---|---|---|---|---|---|---|---|
| I | 13.0 | 41* | 17.2 | 28.8 | S | — | F | 15 |
| J | 9.6 | 43.4 | 17.9 | 29.1* | F | — | — | — |
| K | 12.5 | 40.2 | 18.5 | 29.8* | — | F | — | — |
| L | 12.8 | 40.2* | 20.3 | 26.7 | F | — | — | — |
| M | 12.7 | 41.2* | 22.4 | 23.7 | F | — | — | — |

*by difference

It will be seen from the results of Table II that Alloy Nos. 10 to 15, all of which are within the invention, were both hot and cold-workable and that a reduction of 95% during cold rolling was achieved in all cases without cracking. On the other hand, of Alloys I to M, all of which are outside the invention, only Alloy I was successfully forged and all the remainder failed during hot-working. Following the failure of Alloys J to M, no hot-rolled material was available for cold-rolling.

In particular, comparison of Alloy No. 14 with Alloy J, which both contain approximately the same amounts of nickel and manganese, shows that raising the chromium content above 15%, i.e., from 12% of Alloy No. 14 to the 17.9% of Alloy J, at the expense of iron leads to poor workability.

The 15% reduction of Alloy I during cold-rolling was not considered to be successful and clearly compares very unfavorably with the reduction achieved using the alloys of the invention.

The criticality of the 15% chromium maximum in respect of hot workability is also shown by hot-stamping tests in which alloys were air-melted and cast as 9 or 10 kg ingots, forged at 900° C. to approximately 40 mm diameter bar and machined to 32mm bar. 38mm lengths were cut from the bar and flattened to 13mm thick discs by one blow of a forging hammer on one end of the bar. In this severe test, small edge cracks appeared in discs made from an alloy containing 10% nickel, 15% chromium, 30% manganese, balance iron (Alloy No. 16) at each of the forging temperatures 800°, 850°, 900°, 950° C. whereas no cracking was observed in discs made from an alloy containing 14% nickel, 10% chromium, 31% manganese, balance iron (Alloy No. 17) at the same forging temperature.

Further alloys which illustrate that it is essential to maintain the alloy composition within the range defined by the invention are shown in Table III. As before, these alloys were air-melted and cast as 3 kg ingots which were then hot-rolled at 900° C. and , if successfully hot-rolled, were subsequently cold-rolled.

TABLE III

| Alloy | Composition (%) Ni | Fe | Cr | Mn | Hot-Rolling (900° C.) | Cold-Rolling |
|---|---|---|---|---|---|---|
| N | 5.7 | 61.4* | 15.6 | 17.3 | S | F |
| M | 6.4 | 24.0* | 15.3 | 54.3 | ingot cracked on casting | |
| O | — | 40 | 10 | 50 | ingot cracked on casting | |
| P | — | 30 | 15 | 55 | F | — |

*by difference

The failure of Alloys N and M can be attributed to the high iron and low iron contents respectively, the high chromium contents and the low manganese of Alloy N and the failure of Alloys O and P to the lack of nickel.

As stated above, the nickel content of the alloys must not exceed 20% as above this figure the alloys become more difficult to work. This is illustrated by comparison of the tensile properties at 800° C. of Alloys 18 and 19 in Table IV. Tensile tests were performed on samples taken from hot-rolled plate which had been annealed at 900° C. for two hours and air-cooled.

TABLE IV

| Alloy | Composition (%) Ni | Fe | Cr | Mn | Tensile Properties (800° C.) UTS (N/mm²) | Elongation (%) |
|---|---|---|---|---|---|---|
| 18 | 9.9 | 47.3* | 10.6 | 32.2 | 160 | 41 |
| 19 | 20.0 | 41.1* | 10.3 | 28.6 | 270 | 17 |

*by difference

Whereas both alloys were readily hot workable during the preparation of the samples, it can be seen that the elongation of Alloy 19, containing the maximum of 20% nickel, is considerably less than that of Alloy No. 18.

A further indication that is essential to restrict the nickel content to a maximum of 20% is provided by hardness data. These show that the hardness of the alloy decreases slightly with increasing nickel contents up to 20%, but that thereafter the hardness increases with increasing nickel content such that workability is impaired.

The alloys are not appreciably age-hardenable. For example, an alloy containing 35.8% manganese, 15% nickel, 9.9% chromium and the balance iron (Alloy No. 20) had a hardness after hot working of 194 $H_v$ and after annealing for 1 hour at 800° C. and thereafter aging at 500° C. for 1, 4, 16 and 64 hours had a hardness of 136, 130, 136 and 156 $H_v$, respectively.

The alloys exhibit a moderately low work-hardening rate. This is illustrated by the data in Table V for Alloy No. 14, the composition of which is given in Table II.

TABLE V

| Alloy No. | Hardness ($H_v$) After Hot-Working and Annealing 1 hr/900° C | Hardness ($H_v$) after Cold-Rolling: Cold Reduction (%) | Hardness as Rolled | Hardness after Rolling and Annealing 1 hr/900° C |
|---|---|---|---|---|
| 14 | 125 | 20 | 258 | 150 |
| 14 | 125 | 40 | 286 | 150 |
| 14 | 125 | 60 | 322 | 150 |
| 14 | 125 | 80 | 375 | 150 |
| 14 | 125 | 90 | 409 | 150 |

The tensile and impact properties of a typical alloy (No. 14) are provided in Table VI below.

TABLE VI

| Tensile Properties: Temp. (° C.) | 0.2% Proof Stress (N/mm²) | UTS (N/mm²) | Elongation % | Impact Properties: Temp. (° C.) | Impact Strength (J) |
|---|---|---|---|---|---|
| 20 | 330 | 590 | 38.5 | −196 | 107 (average of 3 tests) |
| 200 | 300 | 510 | 28 | | |
| 400 | 215 | 470 | 32 | | |
| 600 | 180 | 350 | 32.5 | | |
| 800 | 90 | 155 | 55.5 | 20 | 153 (average of 3 tests) |
| 900 | 45 | 93 | 70.5 | | |
| 1000 | 25 | 53 | 53 | | |

The tensile tests were conducted on samples of Alloy No. 14 which had been hot-rolled at 900° C. and subsequently annealed at 900° C. for one hour. The impact properties were conducted on standard Charpy V-notch test pieces made from welded plate, the notch of the test piece being in the weld material.

With regard to the optional constituents copper and lead, an alloy containing 24% manganese, 11.5% nickel, 15% chromium, 2.5% copper and balance iron (Alloy No. 21) was readily forgeable but hot-rolling, although not impossible, was difficult to perform. This can be attributed partly to the presence of copper and partly due to the presence of the maximum amount of chromium. An alloy containing 27.0% manganese, 11.5% nickel, 10.0% chromium, 1.5% lead and balance iron (Alloy No. 22) could be both hot- and cold-rolled although reductions of only 50% and 80%, respectively, were possible before cracking was observed.

To exemplify typical coinage alloys, two alloys, Nos. 23 and 24, having the composition shown below were cast as 3 kg ingots. These were hot-rolled at 900° C. and air cooled. They were then machined down to 10 mm and then were cold-rolled (60%) down to 4 mm. Finally, they were annealed for one hour at 1000° C. and air cooled. The low hardness figures of these alloys is provided below.

TABLE VII

| Alloy | Composition (%) | | | | | | Hardness |
|---|---|---|---|---|---|---|---|
| | Ni | Fe | Cr | Mn | C | Si | ($H_v$) |
| 23 | 10 | Bal. | 10 | 20 | <0.1 | <0.1 | 110 |
| 24 | 15 | Bal. | 10 | 20 | <0.1 | <0.1 | 110 |

The alloys of the invention can be advantageously made using ferro-manganese in the furnace charge. However, the grade of ferro-manganese employed must be sufficiently low in silicon and carbon for the workability to be unaffected. Examples of an alloy having a nominal composition of 32% manganese, 13% nickel, 10% chromium, balance iron, and made using two different grades of ferro-manganese are given below.

| Ferro-manganese Grade (%) | Workability |
|---|---|
| 86 Mn, 13 Fe, 0.7 Si, 0.07 C, 0.07 P | Forged and hot-rolled successfully. Cold-rolled to 0.037 mm (95% reduction) |
| 83 Mn, 15 Fe, 1.3 Si, 0.9 C, 0.2 P | Failed in forging and hot-rolling tests |

The failure of the second example can be attributed to the high silicon content.

Ferro-chromium with a low carbon content, for example, 0.015% carbon, may also be employed in the production of the alloys.

A 55 kg ingot (approximately 200mm × 150mm × 100mm) of a preferred alloy of the invention (Alloy No. 25) containing 30% manganese, 10% nickel, 10% chromium and balance iron was prepared using both ferro-chromium and low carbon/low silicon ferro-manganese. The ingot was successfully hot-rolled at 900° C. from 100mm down to 12 mm plate and thereafter 95% cold-rolling was readily effected without cracking occurring.

Articles and parts which may advantageously be made from the alloys of the invention are those requiring the combination of good corrosion resistance including resistance to stress-corrosion cracking and good hot and cold workability. Such articles include, for example, plumbing fittings and hot-stamped articles such as door harndles.

Although the invention has been described in connection with preferred embodiments, modifications may be resorted to without departing from the spirit and scope of the invention, as those skilled in the art will readily understand. A given compositional range of one constituent can be used with the given ranges of the other constituents. Such are considered within the purview and scope of the invention and appended claims.

We claim:

1. A substantially non age-hardenable manganese-nickel alloy composition characterized by both good hot and cold workability and in having been satisfactorily hot worked or cold worked or both and being further characterized by improved resistance to both general corrosion and stress-corrosion cracking, the alloy consisting of about 8 to 14% nickel, about 8 to 15% chromium, about 35 to 55% iron and the balance essentially manganese, the manganese constituting at least about 24% of the alloy.

2. A substantially non age-hardenable manganese-nickel alloy composition characterized by both good hot and cold workability and in having been satisfactorily hot worked or cold worked or both and being further characterized by improved resistance to both general corrosion and stress-corrosion cracking and consisting of 5 to 12% nickel, 5 to 15% chromium, from 30 to 60% iron, and the balance essentially manganese, the manganese being from 18 to 55%.

3. A substantially non age-hardenable manganese-nickel alloy composition characterized in having been satisfactorily hot worked or cold worked or both and being further characterized by improved resistance to both general corrosion and stress-corrosion cracking, the alloy consisting essentially of from 5 to 15% nickel, 5 to 12% chromium, 30 to 60% iron, up to 2.5% copper, up to 2% lead, up to 1% silicon, up to 0.25% carbon and the balance essentially manganese, the manganese being from 18 to 55%.

4. An alloy in accordance with claim 1 containing about 8% to 12% chromium.

5. An alloy in accordance with claim 1 containing 8 to 12% nickel, about 8 to about 12% chromium and about 40 to about 50% iron.

6. An alloy in accordance with claim 2 containing about 8 to 12% nickel, at least 8% chromium and not more than 40% manganese.

7. An alloy in accordance with claim 2 adopted for coinage production and containing about 10 to about 12% nickel, 8 to 12% chromium, from 18 to 25% manganese and about 51 to 60% iron.

8. As a new article of manufacture, a coin having the composition given in claim 7.

* * * * *